United States Patent [19]

Goda

[11] Patent Number: 4,915,284

[45] Date of Patent: Apr. 10, 1990

[54] STRIP METAL FEEDING MECHANISM

[76] Inventor: Ben T. Goda, 24302 S. Berendo Ave., Harbor City, Calif. 90710

[21] Appl. No.: 876,281

[22] Filed: Jun. 17, 1986

Related U.S. Application Data

[63] Continuation of Ser. No. 715,055, Mar. 22, 1985, abandoned, which is a continuation of Ser. No. 527,981, Aug. 31, 1983, abandoned.

[51] Int. Cl.[4] ..... B65H 20/02

[52] U.S. Cl. ..... 226/177; 226/189; 226/190

[58] Field of Search ..... 226/176, 177, 187, 181, 226/188, 190, 152, 153, 154, 155; 72/249; 83/261; 74/352, 396, 397

[56] References Cited

U.S. PATENT DOCUMENTS

| | | | |
|---|---|---|---|
| 2,433,477 | 12/1947 | O'Quinn et al. | 226/187 X |
| 2,548,136 | 4/1951 | Auer | 226/187 X |
| 2,693,273 | 11/1954 | Kopplin | 226/177 |
| 2,726,083 | 12/1955 | Lewis, 3rd | 226/187 X |
| 2,863,660 | 12/1958 | Delafontaine | 226/187 X |
| 3,014,628 | 12/1961 | Littlehale | 226/177 |
| 3,052,393 | 9/1962 | McKenzie | 226/177 |
| 3,246,822 | 4/1966 | Skeen | 226/155 |
| 3,647,127 | 3/1972 | Wiig | 226/177 X |
| 3,653,569 | 4/1972 | Homstead et al. | 226/153 X |
| 3,657,940 | 4/1972 | Wagner | 226/187 X |

*Primary Examiner*—Philip R. Coe
*Assistant Examiner*—Scott J. Haugland
*Attorney, Agent, or Firm*—Edward A. Sokolski

[57] ABSTRACT

A roller guide system which includes at least a pair of rollers for feeding strips of material between predetermined maximum and minimum thicknesses therebetween is rotatably driven by means of a gear train. The rollers are rotatably mounted on upper and lower housing frames respectively for rotation about first and second parallel axes. The upper frame is slidably mounted on the lower frame for vertical movement relative thereto. Each of the rollers has a spur gear attached thereto for rotation along with its associated roller about said first and second axes, respectively, these gears being interconnected by intercoupling gearing. The center of the gear attached to the roller mounted on the upper frame is at the same level as the center of the gear which drives this gear when feeding strips of an intermediate thickness between said maximum and minimum thicknesses. The vertical spacing between the rollers automatically adjusts in response to the thicknesses of the strips of material fed therebetween by virtue of slideable vertical motion between the frames, the gears being minimally unmeshed with such motion.

10 Claims, 2 Drawing Sheets

STRIP METAL FEEDING MECHANISM

This is a continuation of application Ser. No. 715,055 filed Mar. 22, 1985, now abandoned, which is a continuation of application Ser. No. 527,981 filed Aug. 31, 1983, also abandoned.

This invention relates to a roller drive system for accurately feeding material such as strip or sheet metal or plastic of varying thicknesses and more particularly to a simple and straight-forward roller drive system that provides for accurate feeding or indexing of the material with optimum meshing of the driving and driven gears and without any tendency for erratic or non-uniform motions as a result of improper gear meshing.

In the art of automated machinery, there is a need for automatically feeding thin material in an accurate and positive manner that provides for accurate indexing or movement of the material into cutting or processing machinery. Punch press feeding mechanisms require that strip metal be fed in accordance with preprogrammed controls that provide for accurate movement of the strip metal and without any tendency of the material to bend o bind as a result of rollers used to drive or feed the material.

The prior art very early washing machines used a gear attached to the lower roller that was driven via a motor which in turn drove a gear attached to the upper roller. The distance of separation between the driving and driven gears varied directly according to the thickness of the material being fed. This variation in the center distance between the driving and driven gears caused ratchet-like and non-uniform rotation of the rollers.

It was always known that it was necessary to maintain a perfect mesh along the diameter of the pitch circle to thereby maintain precise control over the movement of the rollers feeding the material. The precise meshing along the pitch diameter is accommodated in the prior art for different thicknesses of material by rotating the rollers contained in the upper case about the rollers contained in the lower case so as to always maintain the constant meshing relationship. A review of the prior art will show feeding mechanisms for feeding material of varying thicknesses and which employ swinging arms that rotate as the thickness of the material varies.

A review of Pat. No. 3,014,628 issued Dec. 26, 1961 to B. M. Littlehale discloses two swinging mechanical arms for a specific purpose in conjunction with an extrusion die. The features of the Littlehale design are not relevant to the present invention, however, the design does illustrate the concept of utilizing swinging mechanical arms pivoting about a center so as to maintain the driving and driven gears in a constant theoretical meshing relationship along the pitch diameter regardless of the thickness of the material being fed. Specific reference is made to FIG. 1 and pivot points 3 and 8.

Pat. No. 3,246,822 issued Apr. 19, 1966 to G. R. Skeen also discloses the swinging arm concept which allows the upper rollers to pivot about the lower rollers as the thickness of the material being fed varies. Specific reference is made to FIG. 2 where the meshing of the driving gear and the driven gear is maintained theoretically perfect along the constant pitch diameter.

Pat. No. 2,693,273 issued Nov. 2, 1954 to J. V. Kopplin has features that are more similar to those described in the present invention. Unfortunately, Kopplin is concerned only with feeding resilient material such as felt or other fabric material and is not concerned with feeding strip metal or non-resilient material of the type disclosed herein.

Kopplin discloses a lower frame containing a plurality of rollers and an upper frame containing a plurality of rollers, which rollers are adapted to drive material in a given direction and at a controlled rate. The upper roller is located by means of a swinging arm which pivots about the center of the upper auxiliary gear. This pivoting action assures that all gears are meshing properly on their theoretical pitch circles.

In the present invention the swinging arm concept is eliminated and all vertical motions are restrained by suitable alignment pins and grooves which maintain the vertical relationship between the upper case and the lower case.

In the present invention all gears are perfectly meshed except for the interface between the upper driving gear and the upper driven gear. At this interface it was discovered that a small variation from theoretically perfect meshing is well within normal machining tolerances. Such minor deviations from perfection do not materially affect the meshing of the two gears and do not affect the accuracy of the strip metal being fed or indexed. The very small error introduced is well within the operating range of precision spur gears of AGMA Quality 10 or better having a diametral pitch of 24 or 32. In this manner nearly perfect meshing of the upper driving gear and the upper driven gear is provided and the minor deviation from perfection from the pitch diameter allows for direct control of the strip metal being fed or indexed and without the disadvantages of the swinging mechanical linkages used in the prior art devices.

In the Kopplin system as in the other prior art systems, the locus of points of the upper roller center is an arc of a circle by virtue of the pivoting action. This pivoting action displaces and offsets the vertical relationship between the lower and upper rollers under the presence of a varying thickness of material being driven by the opposing rollers.

Offsetting the vertical relationship between the upper and lower rollers causes the material or strip metal being fed to bend or otherwise apply a bending force to the metal thereby causing the metal to move in an upward arc which destroys the precise linear indexing of the strip metal being fed. Bending of the metal being fed gives rise to inaccuracies in the feed length increments, especially when feeding metal into a punch press. In the usual stop and go applications, bending forces on the metal being driven causes undesirable and extraneous transient flutter motions, resulting in further inaccuracies.

Until the advent of the present invention, most prior art strip metal feeding mechanisms used upper rollers that rotated relative to the lower rollers and by this action caused a bending of the strip metal and an interference with the linear indexing or feeding of the strip metal being fed.

In the present invention the upper rollers are positioned in an upper housing that is restrained from moving in other than in a vertical direction relative to the lower housing. In this manner the upper rollers are always maintained directly over the lower rollers which maintains the indexing or feeding rate of the strip metal and prevents bending of the strip metal as the thickness of the strip metal varies.

The vertical alignment of the upper and lower rollers is maintained at all times which also lends itself to more convenient propagation of the system to multiple sets of rollers. Without swinging mechanical linkages the upper case is more readily removable from the lower case and provides for simple inspection, maintenance and change of the rollers in both the upper and lower cases.

Further objects and advantages of the present invention will be made more apparent by referring now to the accompanying drawings wherein.

Figure 1:
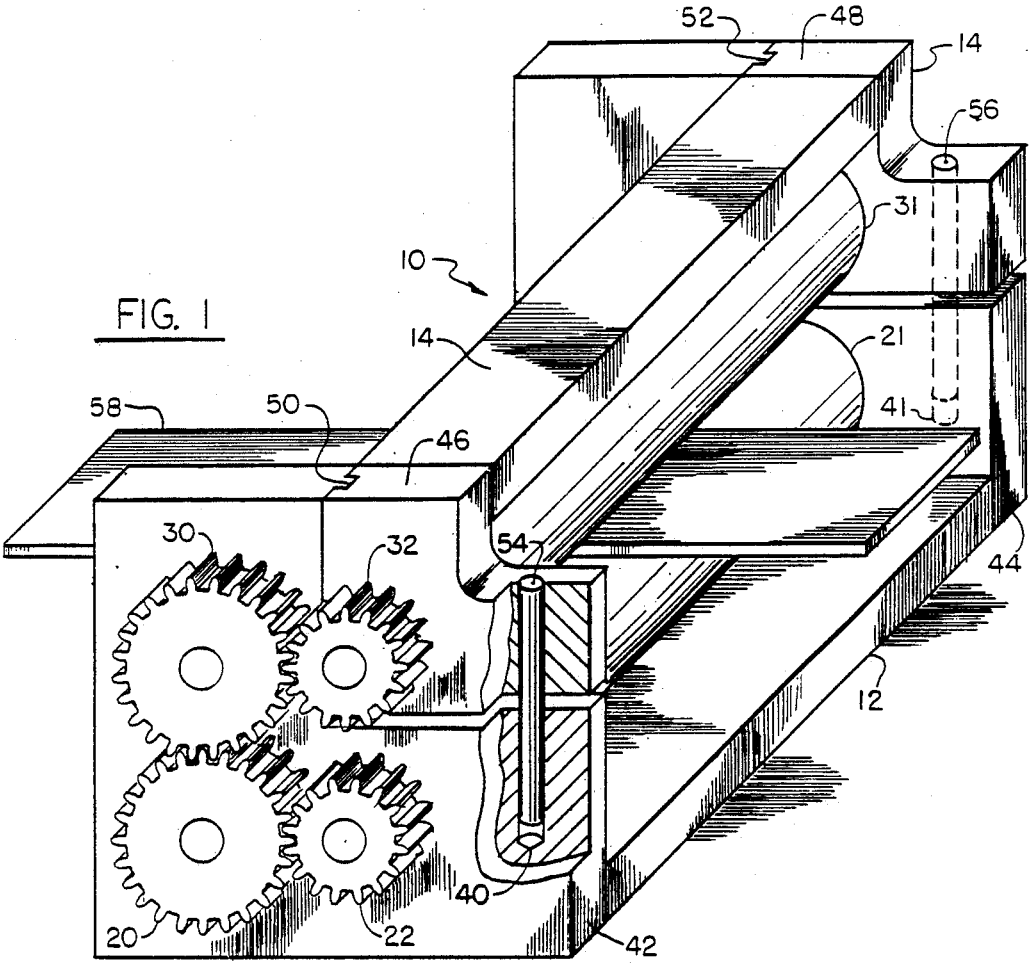
FIG. 1 is a perspective drawing of a first embodiment illustrating a basic roller drive system constructed according to the present invention and with a vertically sliding upper frame.

Referring now to FIG. 1, there is shown a roller drive system 10 consisting of a lower housing 12 and an upper housing 14.

The lower housing contains roller 21 driven by gear 22. Gear 22 is driven by gear 20 which also drives gear 30. Not shown is a source of prime motive power such as a servo motor which drives gear 20. Gear 30 interfaces with the upper housing 14 and supplies it with motive power.

The upper casing 14 contains roller 31 driven by gear 32. Gear 32 is driven by gear 30 of the lower assembly via a tangentially sliding gear meshing interface between the upper housing and the lower housing.

Side plates 42 and 44 of lower casing 12 contain accurately machined tongue guides at the vertically sliding interfaces. These sides also contain accurately machined openings or holes 40 and 41 adapted to accept guidepins 54 and 56 attached to the upper casing 14.

The upper frame 14 is constructed in a similar fashion to the lower frame and contains side plates 46 and 48 having accurately machined grooves 50 and 52 at one end and accurately located pins 54 and 56 at other end, respectively.

Grooves 50 and 52 are adapted to mate with guides in the lower housing, respectively, whereas pins 54 and 56 are adapted to slide within the openings 40 and 41, respectively, located in sides 42 and 44 of the lower frame. In this fashion the upper frame is allowed to move only in a vertical direction.

Rollers 21 and 31 driven by gears 22 and 32, respectively, are disposed vertically one above the other. The insertion of strip metal 58 between the aforementioned rollers allows the upper case 14 to move vertically with respect to the lower case 12 and at all times the relationship of the rollers is always maintained one above the other, thereby eliminating any tendency for the upper roller to pivot as is disclosed in the prior art systems.

Figure 2:
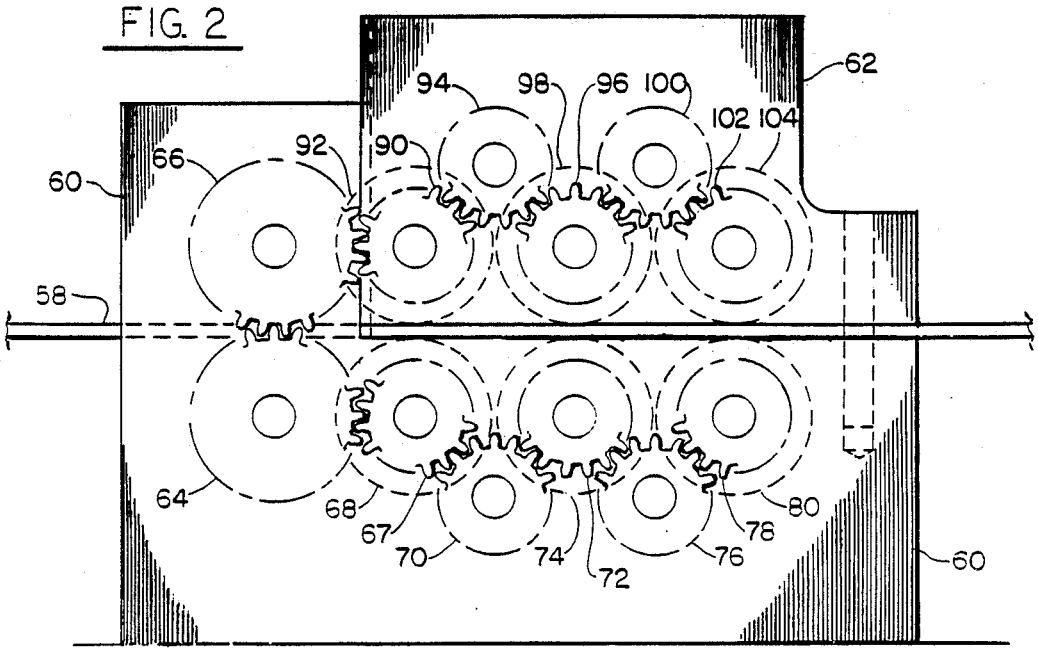
FIG. 2 is a side view of a second embodiment illustrating an extension of the roller drive system to multiple sets of rollers.

Referring now to FIG. 2 of a second embodiment of the invention, there is shown a side view illustrating a more sophisticated roller drive system resulting from the simple propagation of the basic system of FIG. 1 to contain three sets of upper and lower rollers. All components of the basic system are retained. Additional components are added as necessary into a larger lower housing 60 and a larger upper housing 62.

A larger lower frame 60 contains a main driving gear 64 driving an upper driving gear 66 and a roller gear 67 connected to roller 68. The following components are added. Idler gear 70 driven by roller gear 67 drives roller gear 72 connected to roller 74. Gear 72 drives idler gear 76 which in turn drives roller gear 78 connected to roller 80.

A larger upper frame 62 contains the roller gear 90 connected to roller 92. In addition, idler gear 94 driven by gear 90 drives roller gear 96 connected to roller 98. Gear 96 drives idler gear 100 which in turn drives roller gear 102 connected to roller 104.

In the expanded system of FIG. 2, all features of the basic system of FIG. 1 are retained. This illustrates the ease with which the system can be propagated to incorporate a plurality of sets of upper and lower rollers.

Referring now to FIG. 3, there is shown three configurations for three different metal thicknesses of the basic roller drive system employing the concept of a vertically sliding gear meshing interface.

To be most useful for processing strip or sheet metal, a roller drive system is designed to accommodate metal thicknesses from zero, paper thin in practice, up to a given maximum thickness, usually of one-eighth of an inch. FIG. 3 shows three views of the basic gear train. Gear 20 is the main driving gear which drives the upper driving gear 30 and gear 22 connected to the lower roller 21. Gear 30 drives the upper roller 31 via gear 32 at the vertically sliding gear meshing interface.

Figure 3A:
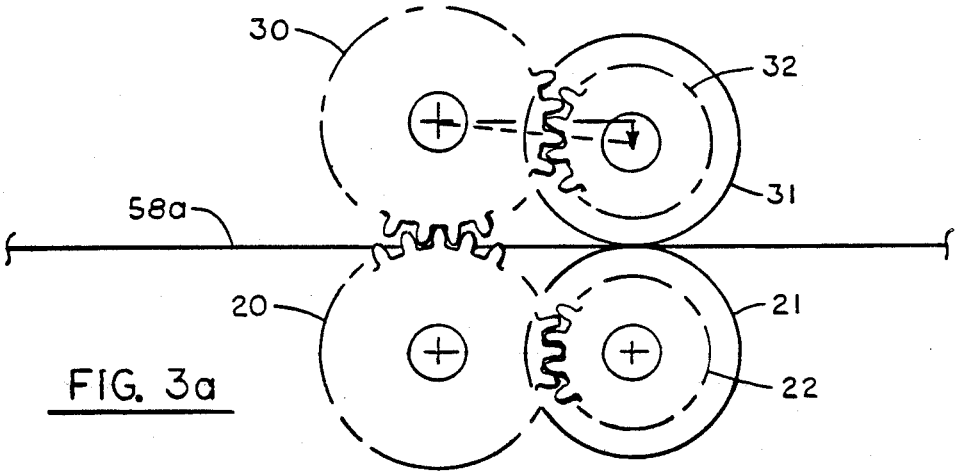
FIG. 3 illustrates the vertical movement of the upper driven gear of the first embodiment illustrated in FIG. 1 for three given thicknesses of strip metal and the nearly perfect meshing of driven gear relative to the driving gear.
Figure 3B:
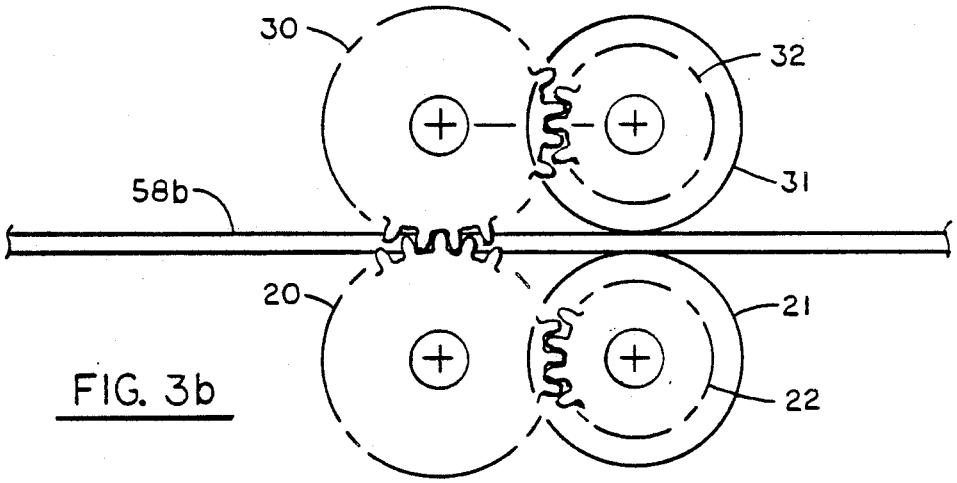
Figure 3C:
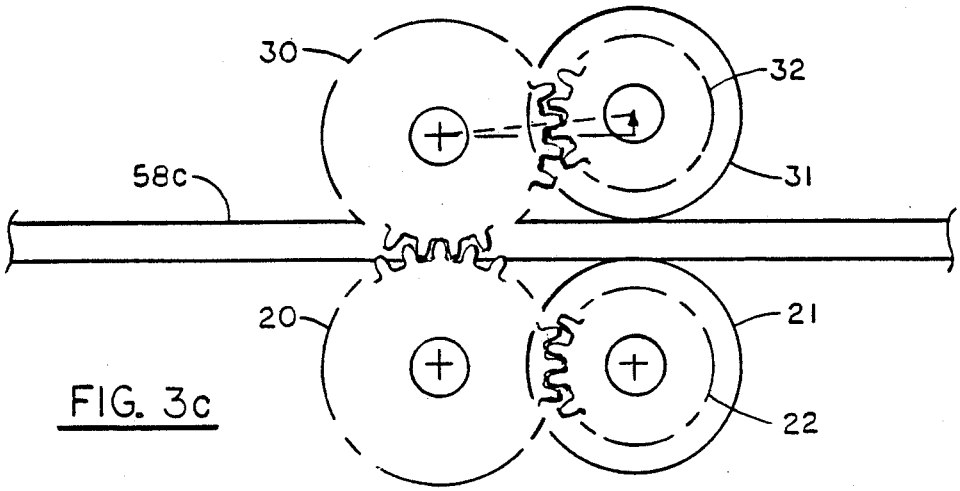

FIG. 3*a* shows that when driving very thin material 58*a* the center of gear 32 is somewhat below the center of gear 30 by a distance equal to one-half of the maximum metal thickness for which the system is designed. FIG. 3*b* shows metal 58*b* whose thickness is exactly one-half of the maximum. The center of gear 32 is now at the same level as that of gear 30. In FIG. 3*c* metal 58*c* of the maximum thickness is being fed. Now the center of gear 32 is somewhat above the center of gear 30 by a distance equal to one-half of the maximum thickness. The distance from the center of gear 30 to the center of gear 32 is referred to as the center distance. For accurate gear meshing the center distance must be held as constant as possible.

The center distance is the longest in FIGS. 3*a* and 3*c* and shortest in FIG. 3*b*. The theoretically ideal center distance is equal to one-half of the sum of the pitch diameters of gears 30 and 32. The total anticipated error is computed and split between the two extreme conditions of FIG. 3*b* and FIGS. 3*a* and 3*c*. Thus, the center distance in FIGS. 3*a* and 3*c* is slightly longer than the ideal center distance. The center distance in FIG. 3*b* is slightly shorter than ideal and this dimension is designed to be the horizontal distance between the centers of gears 30 and 32. This dimension will become the horizontal base line of a very acute right triangle in the subsequent discussion.

An imaginary very acute right triangle may now be formed with the horizontal distance between gears 30 and 32 as the base line. The height of this triangle is one-half of the maximum metal thickness in either the upward or downward direction. This height is also equal to the maximum vertical displacement of the center of gear 32 above or below the center of gear 30. The hypotenuse of the triangle represents the center distance between gears 30 and 32. It is well known in mathematics that the hypotenuse of a very acute right triangle is only slightly longer than the base line. Thus, the center distance may be readily computed for any condition of metal thickness and the resulting vertical displacement of the upper roller gear 32.

In one embodiment of the invention the driving gears 20 and 30 are 1.5000 inches in pitch diameter, the roller gears 22 and 32 are 1.2500 inches in pitch diameter, and the rollers 21 and 31 are 1.3933 inches in diameter. Strip metals from paper thin to 0.1250 inch in thicknesses are driven. The ideal center distance for gears 30 and 32 is 1.3750 inches and the maximum orthogonal offset due to metal thickness is plus or minus 0.0625 inch. Temporarily using a base line dimension of 1.3750 inches and a height of 0.0625 inch in the aforementioned triangle, the total error is shown to be 0.0014 inch. This total error is split about the ideal center distance resulting in the maximum error of plus or minus 0.0007 inch. The base line is now designed to be 1.3743 inches and the maximum center distance is 1.3757 inches. This small error is well within normal machining tolerances and in a practical design such small errors are negligible and do not detract from the proper meshing of the gears 30 and 32. As a matter of academic interest, perfect meshing is obtained for two intermediate metal thicknesses of 0.0186 and 0.1064 inch.

The basic gear train employing a tangentially sliding gear meshing interface is the main concept of the present invention. It is based upon sound mathematical and engineering principles. Its slight concession from theoretical perfection is negligible as this is well within the machine tolerances of a practical design.

This concept is particularly suitable in the design of a roller drive system for a sheet or strip metal feeder. The design provides accurate meshing of the gears without swinging mechanical linkages and leads to a simple straight-forward machinery. The vertically sliding upper assembly preserves the vertical relationship between the upper and lower rollers preventing any bending forces upon the metal being fed. The system is easily expandable to accommodate a multiplicity of sets of upper and lower rollers. The upper assembly is easily removable for convenient set-ups, inspections and maintenance.

I claim:

1. A gear driven roller drive system for feeding strips of material of various thicknesses between a predetermined maximum thickness and a predetermined minimum thickness therethrough with a minimal unmeshing of the drive gears with differences in the thicknesses of the strips comprising, a lower housing (12);

an upper housing (14);

means (50, 52, 54, 56) for supporting the upper housing solely for slidable linear vertical movement relative to the lower housing, the upper housing being restrained against movement relative to the lower housing except for said vertical movement;

first roller means (21) supported solely for rotatable motion on said lower housing for rotation about a first axis;

second roller means (31) supported solely for rotatable motion on said upper housing directly opposite and above said first roller means for rotation about a second axis parallel to said first axis;

first gear means (22) attached to said first roller means for rotation therewith about said first axis;

second gear means (32) attached to said second roller means for rotation therewith about said second axis; and gear train means (20, 30) for rotatably interconnecting said first and second gear means, said gear train means, including a drive gear (30) mounted solely for motion rotatably on said lower housing and which engages said second gear means and rotates about an axis parallel to said second axis;

the spacing between said rollers automatically changing to adjust for strips of different thicknesses, the center of said second gear means being at the same level as the center of said drive gear when feeding strips of predetermined intermediate thickness between said predetermined maximum and minimum thicknesses, the center of said second gear means being at a higher level than the center of said drive gear when feeding material of a greater thickness than said intermediate thickness and at a lower level than at the center of said drive gear when feeding material of a lesser thickness than said intermediate thickness;

whereby when strips of material of various thicknesses are fed between said first and second roller means, the vertical spacing between said first and second roller means automatically adjusts in accordance with the thicknesses of said strips of material without significantly unmeshing said second gear means and said drive gear, the horizontal distance between the centers of the second gear means and the drive gear remaining constant, the vertical distance between the centers of the second gear means and the drive gear varying by a small fraction of the horizontal distance between the centers of the second gear means and the drive gear.

2. The roller drive system of claim 1 wherein the means for supporting the upper housing for vertical movement comprises openings (40, 41) formed in at least one of the housings and pins (54, 56) mounted in said openings.

3. The roller drive system of claim 2 wherein the means for supporting the upper housing for vertical movement additionally comprises guides formed in one of said housings and grooves (50, 52) formed in the other of said housings, the grooves and guides matingly engaging each other.

4. The roller drive system of claim 1 wherein said first and second gear means each comprises a spur gear, each of said roller means comprising a single roller.

5. The roller drive system of claim 1 wherein each of said roller means comprises a plurality of rollers (92, 98, 104, 68, 74, 80), said gear means comprising a spur gear (90, 96, 102, 67, 72, 78) attached to each of said rollers respectively.

6. The roller drive system of claim 1 wherein said upper housing is slidably supported on said lower housing and moves vertically relative thereto in response to the thicknesses of the strips fed between the roller means.

7. The roller drive system of claim 1 wherein the center-to-center distance between said drive gear (30) and said second gear means (32) is represented by the hypotenuse of a right triangle with a very acute angle, the side of the triangle other than the hypotenuse and adjacent to the very acute angle being represented by the constant horizontal distance between said drive gear and second gear means, the side opposite to the very acute angle being represented by the vertical spacing between said drive gear and said second gear means which changes in accordance to the thickness of the strip material, this vertical spacing being of a small fraction of the constant horizontal distance and being at right angles to the horizontal distance, resulting in variations of the center-to-center distance between said drive gear and second means many times smaller than the vertical movement due to various material thicknesses.

8. The roller drive system of claim 1 wherein the variations in the center-to-center distance between said drive gear (30) and said second gear means (32) due to feeding strip material of various thicknesses are reduced to a very small value many times smaller than the dimensional variations due to feeding strip material of various thicknesses.

9. The roller drive system of claim 1 wherein the dimensional variations due to feeding strip material of various thicknesses affect the center-to-center distance between said drive gear (30) and said second gear means (32) as an orthogonal vector addition rather than a colinear scalar addition and result in a very small change in said center-to-center distance for accurate meshing of the gears.

10. The roller drive system of claim 1 wherein said upper housing is slidably supported on said lower housing and moves vertically relative thereto in response to the thicknesses of the strips fed between the roller means, said first and second gear means comprising spur gears firmly and rotatably mounted on said upper and lower housings.

* * * * *